US005234651A

United States Patent [19]

Kawai

[11] Patent Number: 5,234,651

[45] Date of Patent: Aug. 10, 1993

[54] DRY-JET WET SPINNING OF FIBERS INCLUDING TWO STEPS OF STRETCHING BEFORE COMPLETE COAGULATION

[76] Inventor: Kigen Kawai, 6050 Plumas St., Apt. G, Reno, Nev. 89509

[21] Appl. No.: 758,822

[22] Filed: Sep. 12, 1991

[51] Int. Cl.[5] ..... D01D 5/06; D01D 5/12

[52] U.S. Cl. ..... 264/184; 264/210.7; 264/211.15; 264/211.16

[58] Field of Search ..... 264/184, 181, 210.7, 264/210.8, 290.5, 211.15, 211.16, 211.17

[56] References Cited

U.S. PATENT DOCUMENTS

| | | | |
|---|---|---|---|
| 3,414,645 | 12/1968 | Morgan, Jr. | 264/210 |
| 3,574,811 | 4/1971 | Jamison | 264/184 |
| 3,767,756 | 10/1973 | Blades | 264/184 |
| 4,263,245 | 4/1981 | Tan | 264/184 |
| 4,342,715 | 8/1982 | Shimada et al. | 264/184 |
| 4,344,908 | 8/1982 | Smith et al. | 264/203 |
| 4,368,615 | 1/1983 | Lammers | 264/184 |
| 4,374,977 | 2/1983 | Fujiwara et al. | 264/184 |
| 4,374,978 | 2/1983 | Fujiwara et al. | 204/184 |
| 4,466,935 | 8/1984 | Bair et al. | 264/184 |
| 4,466,935 | 8/1984 | Bair et al. | 264/85 |
| 4,606.875 | 8/1986 | Chenevey et al. | 264/85 |
| 4,728,473 | 3/1988 | Satoh et al. | 264/184 |
| 4,876,040 | 10/1989 | Park et al. | 264/184 |
| 5,023,035 | 6/1991 | Yang | 264/184 |
| 5,047,500 | 9/1991 | Park et al. | 528/348 |

FOREIGN PATENT DOCUMENTS 53-065413 6/1978 Japan ..... 264/184

OTHER PUBLICATIONS

Fibres From Synthetic Polymers, Rowland Hill, Ed. Aug. 1953 pp. 382–387.

M. Panar et al., "Morpholoy of Poly(p-Phenylene Terephthalamide) Fibers," Journal of Polymer Science: Polymer Physics Ed., vol. 21, pp. 1955–1969 (1983).

L.-S. Li et al., "On the Morphology of Aromatic Polyamide Fibers (Kevlar, Kevlar-49, and PRD-49)," J. Macrol. Sci.-Phys., B 22(2), pp. 269–290 (1983).

*Primary Examiner*—Catherine Timm

*Attorney, Agent, or Firm*—Wegner, Cantor, Mueller & Player

[57] ABSTRACT

A method of making a fiber involves the sequential steps of: a) extruding as a stream a solution of a polymer having a polymer concentration of 4–24 weight % into a non-coagulating fluid; b) stretching the stream while in the non-coagulating fluid at a spinning draft of 25–2000; c) increasing the polymer concentration by at least 2 weight % to a concentration of 20–65 weight %; e) stretching the stream at a stretch ratio of 1.5–10; and f) increasing the polymer concentration in the stream sufficiently to form a fiber.

11 Claims, 6 Drawing Sheets

DRY-JET WET SPINNING OF FIBERS INCLUDING TWO STEPS OF STRETCHING BEFORE COMPLETE COAGULATION

The present invention relates to a method of making a making a polymer fiber from a solution of the polymer. In particular, the present invention relates to an improvement in the method of making a polymer fiber known as "dry-jet wet spinning."

Polymers can be spun into fibers having a variety of uses. In particular, liquid crystalline main chain polymers, such as poly(p-phenylene terephthalamide), have unique physical characteristics making them useful in the production of high-strength fibers. For example, aramid fibers (fibers made from aromatic polyamides) are well known for their strength.

One method of processing linear polymers into fibers is known as dry-jet wet spinning. In this procedure a solution of the polymer, commonly referred to as a "spinning dope," is extruded from a die first through a layer of non-coagulating fluid and then into a coagulating bath. While in the coagulating bath, the solvent is removed from the dope so as to form the fiber. Tension is applied to the fiber as it leaves the coagulating bath. This stretches the fiber, which improves the degree of orientation of polymer molecules in the lengthwise direction of the fiber. While processes such as dry-jet wet spinning produce fibers having good tensile strength, they result in fibers having less than optimum tensile modulus.

In accordance with the present invention there is provided a process for making polymer fibers so as to improve their properties. Accordingly, the present invention is a method of making a fiber comprising the sequential steps of: a) extruding as a stream a solution of a polymer having a polymer concentration of 4–24 weight % into a non-coagulating fluid; b) stretching the stream while in the non-coagulating fluid at a spinning draft of 25–2000; c) increasing the polymer concentration by at least 2 weight % to a concentration of 20–65 weight %; e) stretching the stream at a stretch ratio of 1.5–10; and f) increasing the polymer concentration in the stream sufficiently to form a fiber. The present invention is also a polymer made by a claimed process as well as a polyamide fiber having a tensile strength of at least 1500 MPa and a tensile modulus of at least 200 GPa.

Figure 1:
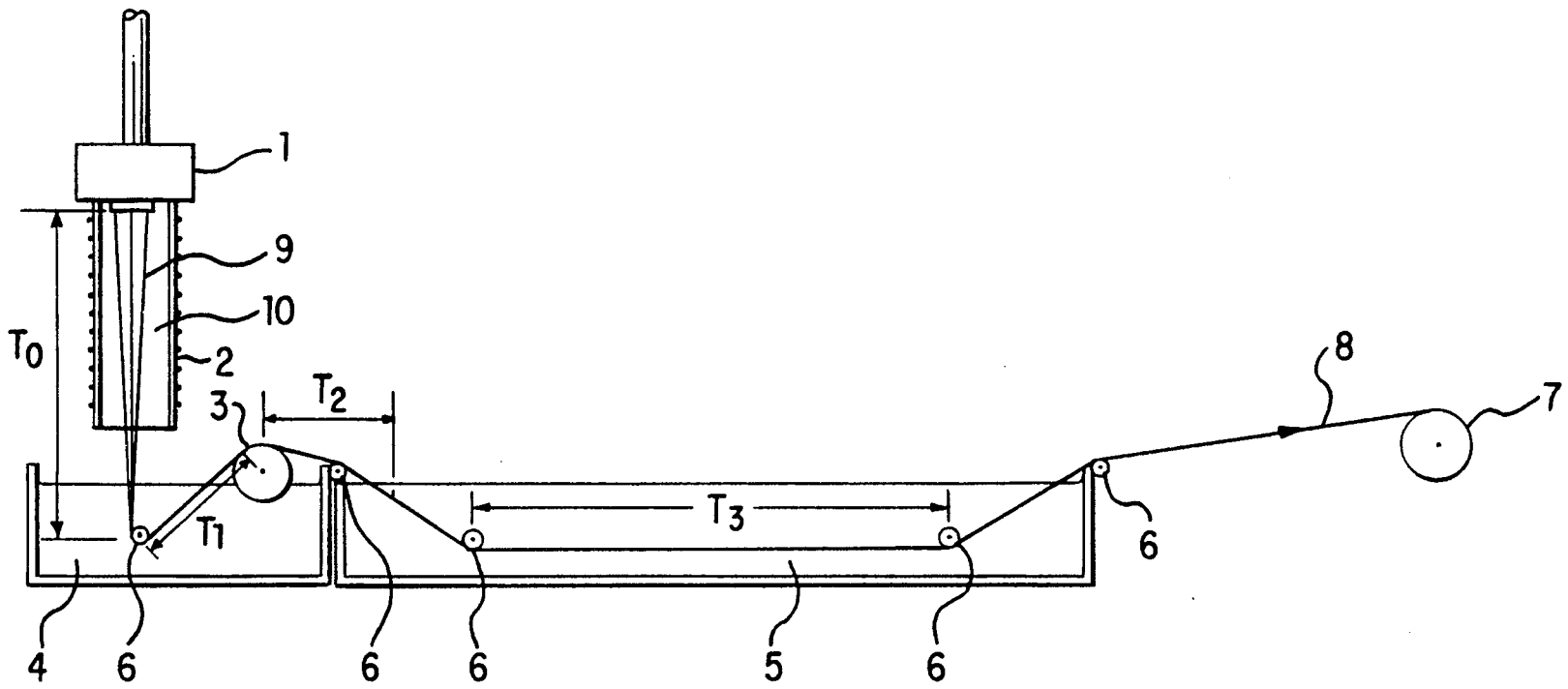
FIG. 1 is a schematic representation of an apparatus for performing a first preferred embodiment of the process of the present invention.

The method of the present invention is useful in making fibers from any polymer that is capable of forming a spinnable solution. Preferably, the polymers useful in accordance with the present invention are linear polymers, especially liquid crystalline main chain polymers, Liquid crystalline main chain polymers are well known liquid crystalline polymers (see Alger, *Polymer Science Dictionary,* Elsevier Applied Science (1989)) in which the crystalline units are part of the main polymer chain and are linked together by either rigid links, giving a rigid polymer backbone as in aromatic polyesters, aromatic polyamides, and poly-(p-phenylenebenzothiazole), which are known as rigid rod polymers, or flexible links, as in copolymers of ethyleneterephthalate and p-oxybenzoate. Most preferred are the rigid rod polymers. Exemplary polymers include, for example, polyolefins such as polyethylene, polypropylene, ethylenepropylene copolymers, polyoxymethylene, and polyethylene oxide, and aromatic polyamides such as disclosed in U.S. Pat. Nos. 3,414,645, 3,767,756, 4,466,935, and 4,344,908, the disclosures which are incorporated herein by reference. Preferred polymers include the aromatic polyamides (which make fibers known as aramids), which have repeating units of the formula —NH—R—NH—, —CO—R′—NH—, or —CO—R″—CO—, wherein R, R′, and R′ are optionally substituted m- or p-phenylene, Examples of useful polyamides include poly(m-phenyleneisophthalamide) (also known as MPD-I), poly(p-benzamide) (also known as PBA), poly(p-phenyleneterephthalamide), poly(p-phenylene p,p′-biphenylcarboxamide), poly(p-phenylene 1,5-naphthalenedicarboxamide), poly(trans-4,4-dodecahydrobiphenylene terephthalamide), poly(-trans-1,4-cinnamamide), poly(p-phenylene 4,8-quinolinedicarboxamide), poly(1,4-[2,2,2]-bicyclo-octylene terephthalamide), copoly(p-phenylene 4,4′-azoxybenzenedicarboxamide/terephthalamide), poly(p-phenylene 4,4′-trans-stilbenedicarboxamide), and poly(p-phenylene acetylenedicarboxamide). Other useful polymers include polybenzazoles, which have repeating units of the formulas:

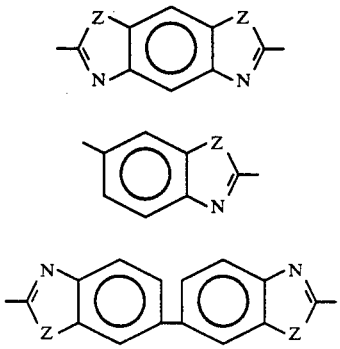

wherein Z is a sulfur atom (known as polybenzothiazoles) or an oxygen atom (known as polybenzoxazoles). Polymers comprising isomers of the repeating units of the foregoing formulas are also useful, such as poly(benzo[1,2-d:4,5-d']bisthiazole-2,6-diyl-1,4-phenylene) (known as trans-PBT) and poly(2,5,-benzoxazole) (known as 2,5-PBO). Exemplary polybenzazoles include homopolymers such as poly(benzo[1,2-d:5,4-d']bisazole-2,6-diyl) (known as cis-PBZ), poly(2,6-benzazole) (known as 2,6-PBZ), and poly(6,6'-bibenzazole-2,2'-diyl (known as 2,2'- PBZ). Useful polymers also include copolymers of aromatic polyamides and polybenzazoles, such as poly(p-phenylene benzobisthiazole).

Solvents in which to dissolve the polymers so as to form spinnable solutions as well as methods of forming the spinning dope are well known, such as disclosed in the aforesaid U.S. Pat. No. 3,767,756. Examples include sulfuric acid, chlorosulfuric acid, fluorosulfuric acid, poly(phosphoric acid), and mixtures thereof. In general, the concentration of the polymer in the spinning dope is 4–24 weight %, preferably 6–22 weight %. For particular polymers, polymer concentration will be governed to some extent by the viscosity requirements for forming a spinnable solution, as will be readily apparent to those of ordinary skill in the art. Techniques for preparing spinning dopes at the appropriate viscosities as well as spinning techniques useful in accordance with the present invention are also well known, such as disclosed in the aforesaid U.S. Pat. No. 3,767,756.

The present invention will now be described in detail with reference to the accompanying FIG. 1, demonstrating a first preferred embodiment of the present invention. As shown in FIG. 1, the spinning apparatus includes spinning head 1, spinning tube 2, first coagulating bath 4, freely turning guide rollers 6, heated drafting roller 3, coagulating bath 5, and stretching roller 7. In operation, spinning head 1 extrudes polymer stream 9 into first non-coagulating fluid 10 contained in spinning tube 2. The stream then passes over freely turning roller 6 in first coagulating bath 4 after which the stream is taken up by drafting roller 3. The stream then passes through second coagulating bath 5 over freely turning rollers 6 and is then wound as a fiber 8 on stretching roller 7.

The temperature at which the polymer solution is spun is sufficiently high to maintain the dope in a liquid state without degrading the polymer. Preferably, the polymer solution is spun at a spinning-head temperature of 70°–100° C., more preferably 70°–90° C. The temperature of the non-coagulating fluid 10 and the distance in the non-coagulating fluid through which the stream 9 passes are determined so that sufficient stretching of the stream in its longitudinal direction occurs while the stream is in the non-coagulating fluid. This stretching is important to ensure that the polymer molecules in the stream are properly oriented. Accordingly, the temperature must be sufficiently warm so that the polymer molecules can reorient themselves freely within the stream. Preferably this temperature is 40°–100° C., more preferably 60°–95° C. The distance that the polymer stream is in the first non-coagulating fluid depends on the initial diameter of the stream, that is, the diameter of the spinning orifice. The larger the spinning orifice the longer the distance needed to stretch the stream to a sufficient extent to reorient the polymer molecules. Preferably, the distance is 5–50 cm, more preferably 15–35 cm. Useful non-coagulating fluids are air, toluene, or heptane. Other useful non-coagulating fluids will be readily apparent to the skilled artisan. Preferably, the non-coagulating fluid is introduced at the bottom of spinning tube 2 so as to flow upward in the tube and then exit the spinning tube through appropriate apertures in the top of the spinning tube. This type of circulation is preferred in order to help prevent saturation of the non-coagulating fluid with solvent vapors.

In the first coagulating bath 4, solvent is removed from the stream 9 to increase the concentration of the polymer in the stream by at least 2 weight %, preferably by at least 10 weight %, to obtain a concentration of 15–70 weight %, preferably 30–40 weight %, in the polymer stream. Accordingly, the material in the first coagulating bath is any material known for use in coagulating baths, such as disclosed in the aforesaid U.S. Pat. No. 3,767,756. The temperature of the first coagulating bath and the distance through which the stream travels therein must be sufficient to effect the necessary polymer concentration. The preferred temperature of the first coagulating bath is 5°–50° C. The distance through which the stream passes in the first coagulating bath must also be sufficient to effect the needed polymer concentration at the temperature of the bath, in general, streams of larger diameter needing longer distances.

Variables such as the size of the extrusion orifice in the spinning head 1, the extrusion rate of the spinning head, and the speed of the drafting wheel 3 are determined to ensure a sufficient stretch in the stream 9, particularly while the stream is in the non-coagulating fluid 10. Accordingly, these variables are adjusted so that a spinning draft of 25–2000, preferably 100–2000, most preferably 150–250 is achieved. The "spinning draft" is the ratio of the velocity of the polymer stream after it leaves the first coagulating bath, which in the preferred embodiment is the same as the speed of the roller 3, to the extrusion velocity $V_0$ of the stream at the spinning head. Extrusion velocity $V_0$ is calculated according to the equation $V_0=4Q/\pi R^2$, where Q is the amount of the stream passing through the spinning head per unit time (extrusion rate) and R is the diameter of the spinning orifice. Preferably, the size of the spinning head orifice through which the dope is extruded is 0.3–4 mm, more preferably 0.5–1 mm. Extrusion rates preferably vary from 0.1–3 g/min, more preferably 0.25–1.5 g/min. In accordance with these parameters, the speed of the heated roller 3 is adjusted to effect the desired spinning draft. Other means for effecting the spinning draft will be readily apparent to the skilled artisan.

After the concentration in the stream 9 is increased in accordance with the present invention in the first coagulating bath 4, it is necessary to additionally stretch the stream in order to more fully orient the polymer molecules in the stream in the desired direction before the stream is formed into the fiber 8 in the second coagulating bath 5. Since the stream 9 was cooled considerably in the first coagulating bath 4 in accordance with the preferred embodiment, it is preferable to raise the temperature of the stream sufficiently to enable the polymer molecules to be oriented within the stream during this additional stretching. In the presently disclosed embodiment, this is accomplished by heated drafting roller 3, which preferably raises the temperature of the stream to from 15°–80° C., more preferably 20°–40° C. However, other means for raising the temperature of the stream will be readily apparent to the skilled artisan. If the temperature of the first coagulating bath is higher than 15° C., it is not absolutely necessary to raise the temperature of the stream for the second stretching, although an increase by at least 5° C. might be advantageous in some instances to permit a greater stretch.

In the first preferred embodiment, after the first coagulating bath, additional stretching is applied to the stream while in a second non-coagulating fluid (in the present embodiment air, but other non-coagulating fluids are contemplated such as disclosed above for the first non-coagulating fluid) by adjusting the stretching roller 7 to a speed faster than that of heated drafting roller 3. This makes the speed of the fiber 8 at the roller 7 greater than the speed of the stream 9 at the roller 3, which stretches the stream, particularly in the area between the roller 3 and the second coagulating bath 5, that is, while the stream is in the second non-coagulating fluid. Accordingly, the speed of the stretching roller 7 is adjusted to effect a stretch ratio of 1.3–8, more preferably 1.5–3. Other means for stretching the stream to effect the desired stretch ratio will be readily apparent to the skilled artisan.

After passing over heated roller 3, the stream 9 then passes over freely turning guide roller 6 into second coagulating bath 5. Second coagulating bath 5 is for the purpose of removing the remaining solvent from the stream and forming the fiber 8, a fiber being formed when the concentration of the polymer in the material is at least 85 weight %, preferably 85–98 weight %. The forming of fibers using such coagulating baths is well known, such as disclosed in the aforesaid U.S. Pat. No. 3,767,756. Accordingly, parameters of the second coagulating bath such as composition and dipping length will be readily apparent to the skilled artisan. For example, both organic and aqueous fluids, such as methanol, methylene chloride, as well as aqueous solutions of sulfuric acid or ammonium hydroxide, are useful. The dipping time in the second coagulating bath must be sufficient to effect the desired polymer concentration. Preferably, the dipping time is 1–10 seconds, more preferably 1–5 seconds. The temperature of the second coagulating bath is preferably 5°–80° C., more preferably 20°–75° C. Higher temperatures within this range will effect additional stretch of the fiber and will aid in washing out of residual solvent at the end of the bath. After coagulation, the formed fiber can be washed, for example, in a 75° C. hot water bath or spray, to remove additional solvent or otherwise treated, for example by further stretching, in accordance with known procedures. Also, it is preferred that the fiber is heat treated in accordance with known procedures, such as disclosed in the aforesaid U.S. Pat. No. 3,767,756. Preferably, heat treatment is performed by heating the fiber as it passes between a feed roll and take-up roll. Preferably, heat treatment is carried out at between a 15% stretch (speed of take-up roll 15% faster than speed of feed roll) and 10% shrinkage (speed of take-up roll 10% slower than speed of feed roll), more preferably between 3% stretch and 5% shrinkage, most preferably 0% shrinkage (speed of take-up roll and feed roll the same).

In accordance with the present invention, stretching fiber 3% or 15% during heat treatment results in a fiber having higher tensile modulus than if heat treated at 0%, but tensile strength at 3% or 15% stretch is lower than at 0%. For fiber heat-treated and shrunk at 5%, the tensile modulus is lower than 0%, but tensile strength is greater. Accordingly, heat treatment is preferably carried out in accordance with the present invention at 450°–600° C., more preferably 550°–600° C., for 1–10 seconds, more preferably 2–5 seconds. Heat-treated rigid-rod polymer fibers made in accordance with the present invention exhibit improved tensile modulus when compared with the same heat-treated fibers made by prior art processes.

In accordance with the first preferred embodiment of the present invention as disclosed hereinabove, there are several tension zones, $T_0$, $T_1$, $T_2$, and $T_3$, as shown in FIG. 1. In general, when the variables are adjusted in accordance with the present invention, the relative tension T effected in the stream in the zones follows the formula $T_3 \geqq T_2 >> T_1 \geqq T_0$.

Figure 2:
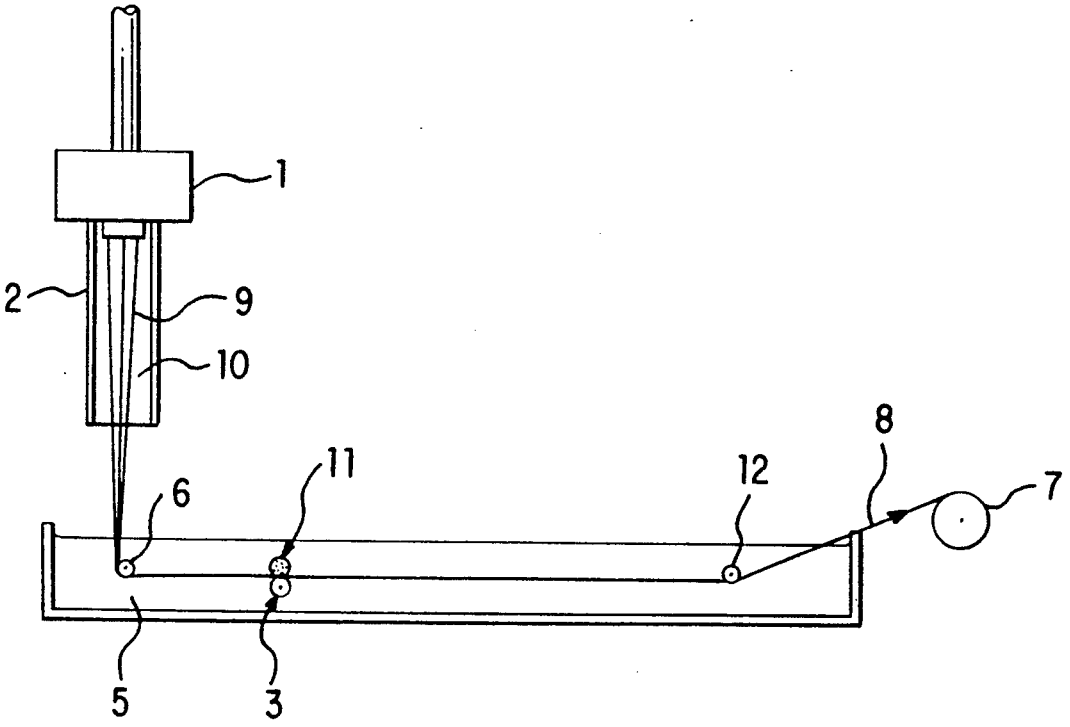
FIG. 2 is a schematic representation of an apparatus for performing a second preferred embodiment of the process of the present invention.

A second preferred embodiment is shown in accompanying FIG. 2. As shown in FIG. 2, the spinning apparatus includes spinning head 1, spinning tube 2, second coagulating bath 5, freely turning guide rollers 6 and 12, drafting roller 3, press roller 11, and stretching roller 7. In operation, spinning head 1 extrudes polymer stream 9 into non-coagulating fluid 10 contained in spinning tube 2. The stream then passes over freely turning roller 6 in coagulating bath 5 after which the stream passes between cooperating drafting roller 3 and press roller 11. The stream then passes through coagulating bath 5 over freely turning roller 12 and is then wound as a fiber 8 on stretching roller 7. Press roller 11 and drafting roller 3 cooperate in such a manner as to control the speed of the stream passing therebetween. In this way, the proper spinning draft is achieved. The distance between the roller 6 and drafting roller 3 is adjusted so that the proper concentration of the polymer in the stream is achieved in order that the stretch that is imparted to the stream after passing between rollers 3 and 11 occurs at the proper polymer concentration. That is, the concentration is increased by at least 2 weight %, preferably by at least 10 weight %, to obtain a polymer concentration of 15–70 weight %, preferably 30–40 weight %, in the polymer stream. The speed of stretching roller 7 is adjusted with relation to the speed of cooperating rollers 3 and 11 in order to effect the proper stretch ratio. That is, the speed of the stretching roller 7 is adjusted to effect a stretch ratio of 1.3–8, more preferably 1.5–3. The temperature of the coagulating bath 5 in the second preferred embodiment, as well as its composition, can be the same as that for the second coagulating bath in the first preferred embodiment. Other variables and conditions can be the same as disclosed for the first preferred embodiment.

Figure 9:
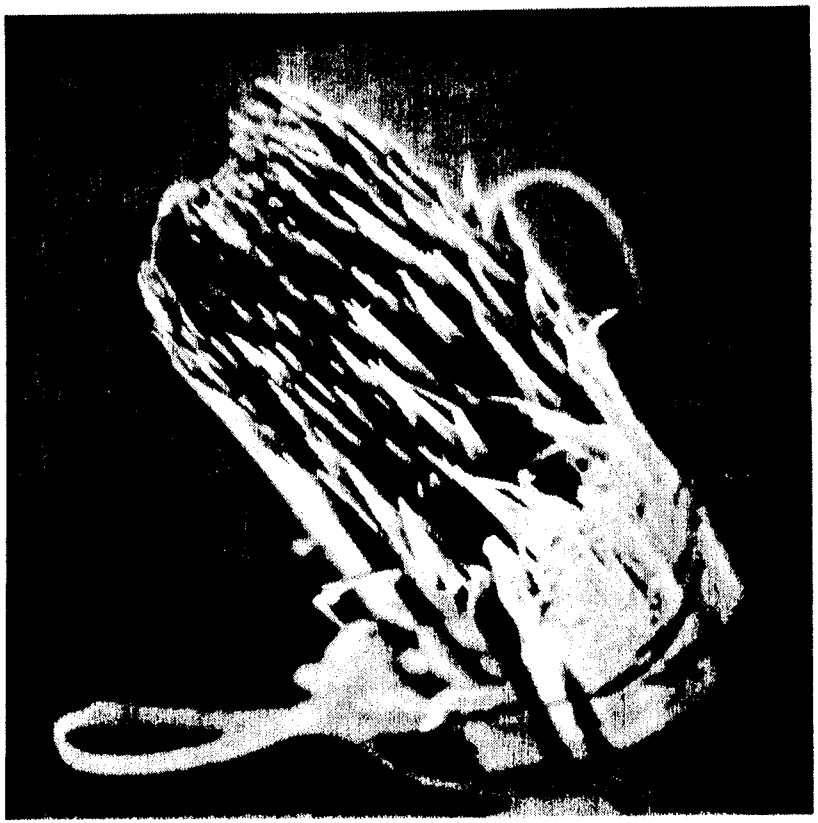
FIG. 9 is a scanning electron micrograph of the broken end of a fiber made according to the present invention (700×).

FIG. 9 is an electron micrograph of a broken end of a poly(p-phenyleneterephthalamide) fiber made in accordance with the present invention. As demonstrated in FIG. 9, the individual fibrils that make up the fiber are all arranged in the longitudinal direction of the fiber. Also as observed in FIG. 9, when the fiber is broken the individual fibrils do not split longitudinally. This is believed due to the existence of an increased number of tying molecules between the individual fibril strands, which is believed to improve the modulus of the fiber.

The foregoing descriptions of the preferred embodiment is provided by way of illustration. Practice of the present invention is not limited thereto and variations therefrom will be readily apparent to the skilled without deviating from the spirit of the present invention.

The following non-limiting examples are provided to further illustrate the present invention. All parts and percentages in the examples are by weight unless indicated otherwise.

EXAMPLES 1–6

Fibers are prepared from a high molecular weight rigid-rod polymer in accordance with the present invention at various stretching concentrations (that is, concentration of polymer after leaving the first coagulating bath). Using the apparatus described herein, the following conditions are followed; spinning solution is poly(p-phenyleneterephthalamide) having an inherent viscosity of 5.2 (obtained from AKZO, Netherlands) dissolved in 99.5% $H_2SO_4$ at a concentration of 7 weight %; extrusion rate is 0.1 g/min.; spinning nozzle orifice diameter is 1 mm; spinning tube length is 7 cm; temperature of spinning solution, nozzle temperature, and spinning tube temperature are 80° C.; first coagulating bath is water at a temperature of 5° C.; temperature of heated drafting roller is 20° C.; the second coagulating bath is water at a temperature of 20° C.: spinning draft is 150. The dipping length in the first coagulating bath is adjusted between 17–70 cm in order to achieve the desired stretching concentration. The dipping length in the second coagulating bath is accordingly adjusted between 30–90 cm to obtain a fiber from the polymer stream. The stretch ratio is adjusted to 0.5× the maximum stretch ratio, the values of which are recorded in the following Table 1. The "maximum stretch ratio" is determined by passing the stream immediately from the drafting roller to the stretching roller and increasing the speed of the stretching roller until the fiber breaks. The polymer concentrations are reported in the following Table 1.

TABLE 1

| Example | Polymer Concentration % | Dip length[1] cm | Stretch Ratio | Dipping Length[2] cm |
|---|---|---|---|---|
| 1 | 12 | 17 | 1.65 | 55 |
| 2 | 24 | 26 | 1.8 | 50 |
| 3 | 33 | 36 | 1.8 | 50 |
| 4 | 41 | 44 | 1.7 | 45 |
| 5 | 47 | 53 | 1.5 | 45 |
| 6 | 56 | 70 | 1.3 | 40 |

[1]First coagulating bath
[2]Second coagulating bath

Following the second coagulating bath the fiber is washed with a hot-water spray (75° C.) to remove residual acid. The final fiber is then heat treated at 0% shrinkage, 550° C., for 5 seconds. The fibers are tested for tensile modulus and tensile strength in accordance with ASTM Method D 3379-75 (1975), and % elongation is the difference between the fiber length at breakage and the original length divided by the original length. The results are recorded in the following Table 2.

TABLE 2

| Example | Denier | Tensile strength MPa | Tensile modulus GPa | % elongation |
|---|---|---|---|---|
| 1 | 3.7 | 2850 | 240 | 2.0 |
| 2 | 3.3 | 3270 | 340 | 1.6 |
| 3 | 3.3 | 3420 | 390 | 1.4 |
| 4 | 3.5 | 3320 | 420 | 1.4 |
| 5 | 3.6 | 3180 | 416 | 1.4 |
| 6 | 4.4 | 2840 | 383 | 1.5 |

As demonstrated in Table 2, the fibers made according to the present invention have an excellent balance of tensile strength and tensile modulus.

EXAMPLES 7–12

A series of fibers are made by redissolving an aramid fiber (KEVLAR 29 available from E. I. du Pont de Nemours Co.) in 95% $H_2O_4$ and spinning the resulting solution to make fibers in accordance with the present invention at various stretching concentrations. Conditions followed are as in Examples 1–6 except as modified below. As in Examples 1–6, stretching concentration is varied by varying the dipping length the stream is in the first coagulating bath between 5–40 cm, and the dipping length in the second coagulating bath is accordingly adjusted such that the final fibers have the same polymer concentration and roughly similar denier. Conditions are recorded in the following Table 3.

TABLE 3

| Example | Polymer Concentration % | Dip length[1] cm | Stretch Ratio | Dipping Length[2] cm |
|---|---|---|---|---|
| 7 | 11 | 5 | 1.8 | 60 |
| 8 | 17 | 12 | 2.1 | 55 |
| 9 | 27 | 23 | 2.4 | 50 |
| 10 | 36 | 35 | 2.2 | 50 |
| 11 | 44 | 45 | 1.9 | 45 |
| 12 | 52 | 60 | 1.6 | 45 |

[1]First coagulating bath
[2]Second coagulating bath

The fibers are tested for tensile modulus and tensile strength in accordance with ASTM Method D 3379-75 (1975). The results are recorded in the following Table 4.

TABLE 4

| Example | Denier | Tensile strength MPa | Tensile modulus GPa | % elongation |
|---|---|---|---|---|
| 7 | 3.3 | 2780 | 152 | 2.8 |
| 8 | 2.8 | 2940 | 213 | 2.6 |
| 9 | 2.5 | 2980 | 291 | 2.2 |
| 10 | 2.7 | 2810 | 331 | 1.7 |
| 11 | 3.1 | 2520 | 342 | 1.6 |
| 12 | 3.7 | 2140 | 314 | 1.5 |

As in Examples 1–6, the fibers made in accordance with the present invention have an excellent balance of tensile strength and tensile modulus.

EXAMPLE 13

Figure 4:
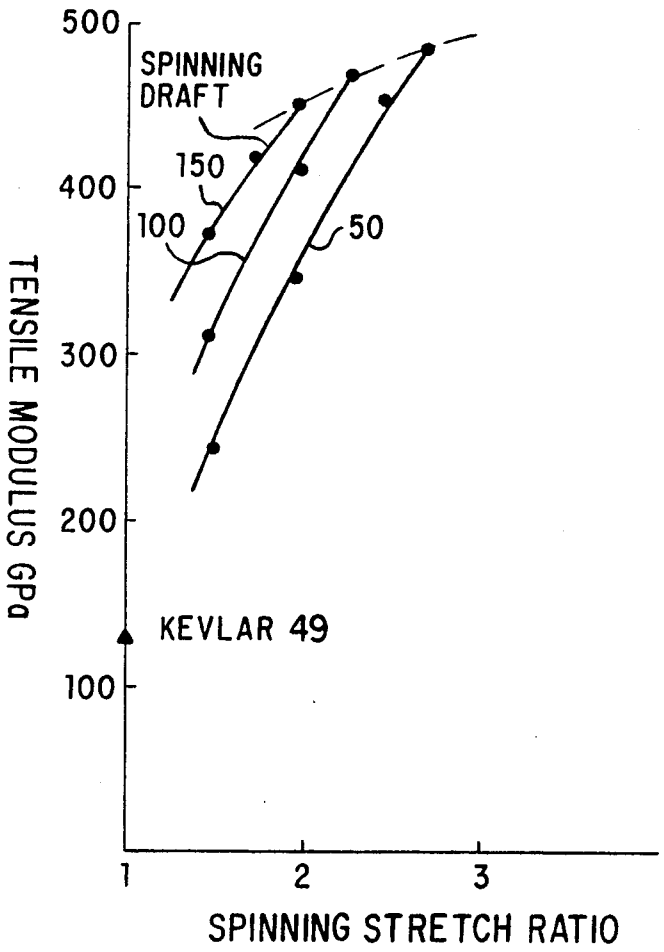
FIG. 4 is a graph plotting the tensile modulus as a function of spinning draft and stretch ratio for various fiber samples.
Figure 3:
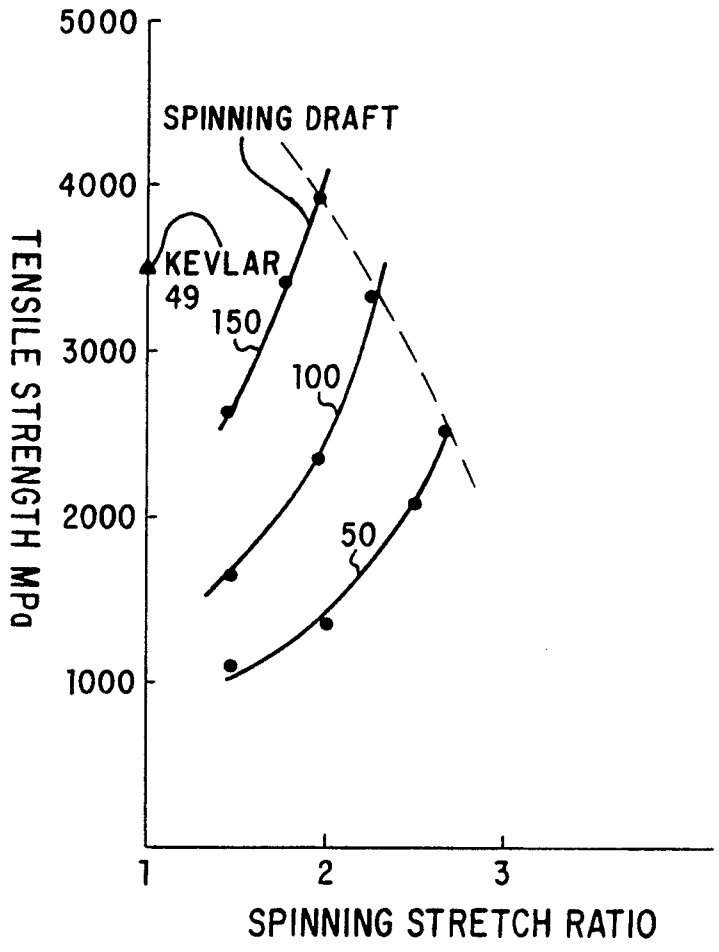
FIG. 3 is a graph plotting the tensile strength as a function of spinning draft and stretch ratio for various fiber samples.

Samples of fiber are made in accordance with the present invention at different spinning drafts. Spinning conditions are as follows: Using the apparatus described hereinabove, the following conditions are follows; spinning solution is poly(p-phenyleneterephthalamide) (as in Examples 1–6) dissolved in 99.5% $H_2SO_4$; concentration of polymer in spinning solution is 20%; temperature of spinning solution, spinning nozzle, and spinning tube are 85° C.; nozzle orifice diameter is 1 mm; extrusion rate is 0.15 g/min; spinning tube length is 7 cm; first coagulating bath is water at a temperature of 5° C.; dipping length in first coagulating bath is 5 cm; polymer concentration at drafting roller is 40%; temperature of drafting roller is 20° C.; second coagulating bath is water at a temperature of 20° C.; dipping length in the second coagulating bath is 60 cm. For each of three spinning drafts (50, 100, 150), samples are made using various stretch ratios. For each sample, tensile strength and tensile modulus are determined as in Examples 1–6. The various stretch ratios and results are recorded in FIGS. 3 and 4. As seen in FIG. 3, the fiber of spinning draft 150, stretch ratio 1.8 (the maximum stretch ratio×0.6 for spinning draft 150) has a higher tensile strength than the fiber of tensile of spinning draft 50, stretch ratio 2.7 (maximum stretch ratio for spinning draft 50). As seen in FIG. 4, the tensile modulus of lower draft/high stretched fiber is higher than for high draft/low stretched fiber, but the difference is not as marked as in tensile strength.

EXAMPLE 14

Figure 6:
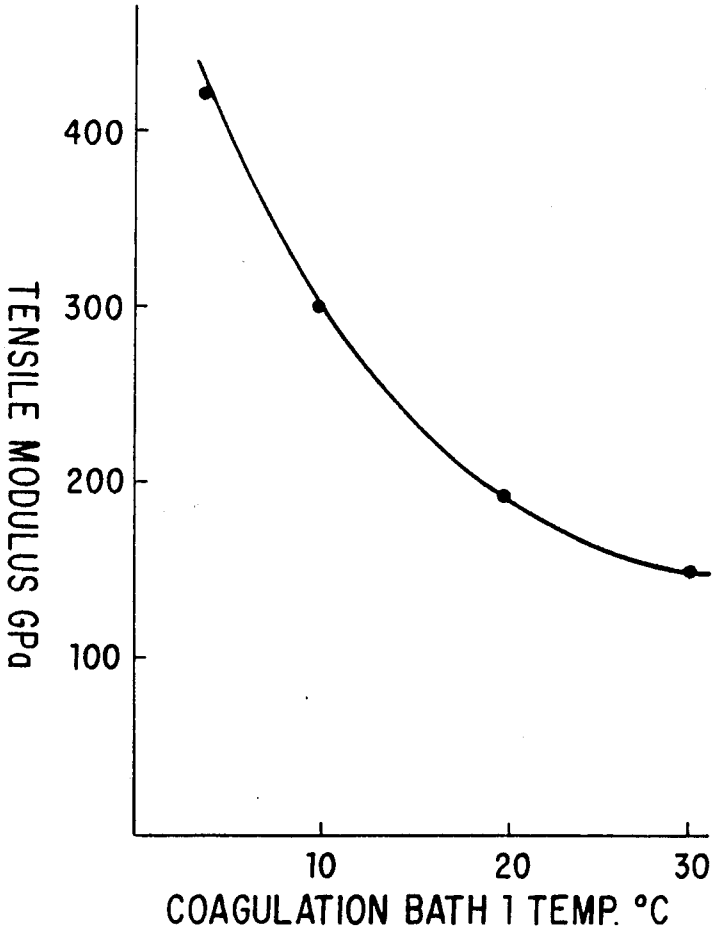
FIG. 6 is a graph plotting the tensile modulus as a function of the temperature of the first coagulating bath for various fibers.
Figure 5:
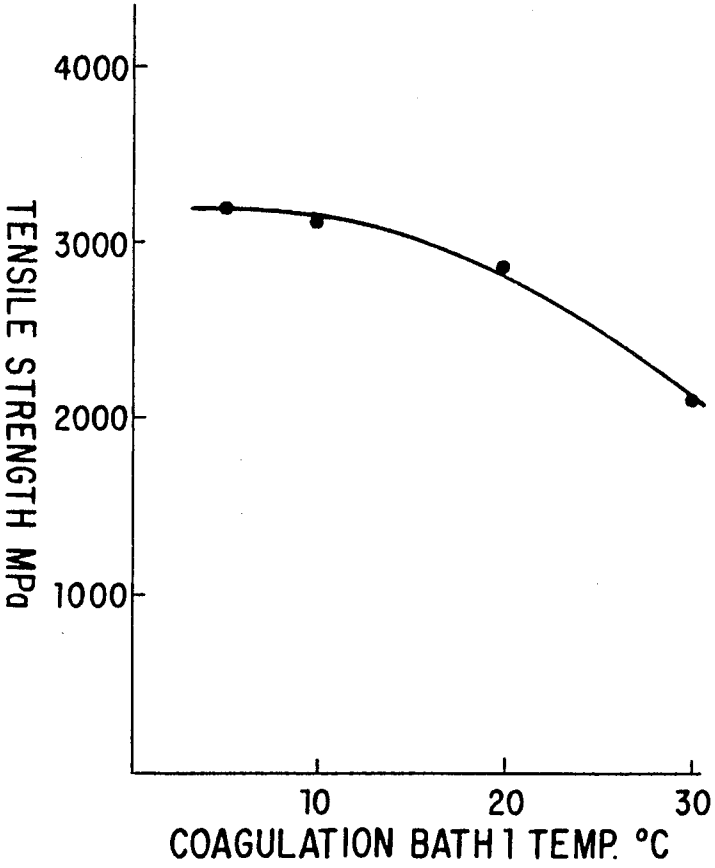
FIG. 5 is a graph plotting the tensile strength as a function of the temperature of the first coagulating bath for various fibers.

Samples of fiber are made in accordance with the present invention using different first coagulating bath temperatures. Using the apparatus described hereinabove, spinning conditions are as follows: spinning solution is poly(p-phenyleneterephthalamide) (as in Examples 1-6) dissolved in 99.5% $H_2SO_4$; concentration of polymer in spinning solution is 20%; temperature of spinning solution, spinning nozzle, and spinning tube are 85° C.; nozzle orifice diameter is 1 mm; extrusion rate is 0.15 g/min; spinning tube length is 7 cm; first coagulating bath is water at a temperature of 5° C.; polymer concentration at drafting roller is 40%; spinning draft is 100; temperature of drafting roller is 20° C.; second coagulating bath is water at a temperature of 20° C.; dipping length in the second coagulating bath is 60 cm; stretch ratio is 2.2. The temperature of the first coagulating bath is varied and the tensile strength and tensile modulus determined as in Examples 1-6. The various temperatures and results are recorded in FIGS. 5 and 6. As seen in the Figs., fiber properties are better at lower temperatures.

EXAMPLE 15

Figure 8:
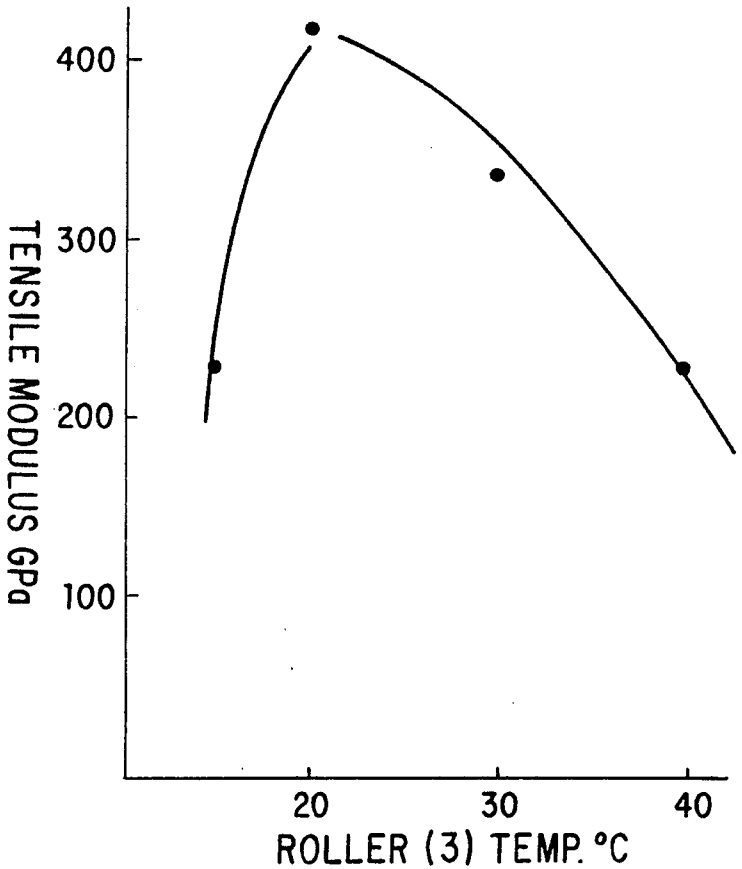
FIG. 8 is a graph plotting the tensile modulus as a function of the temperature of a drafting roller for various fibers.
Figure 7:
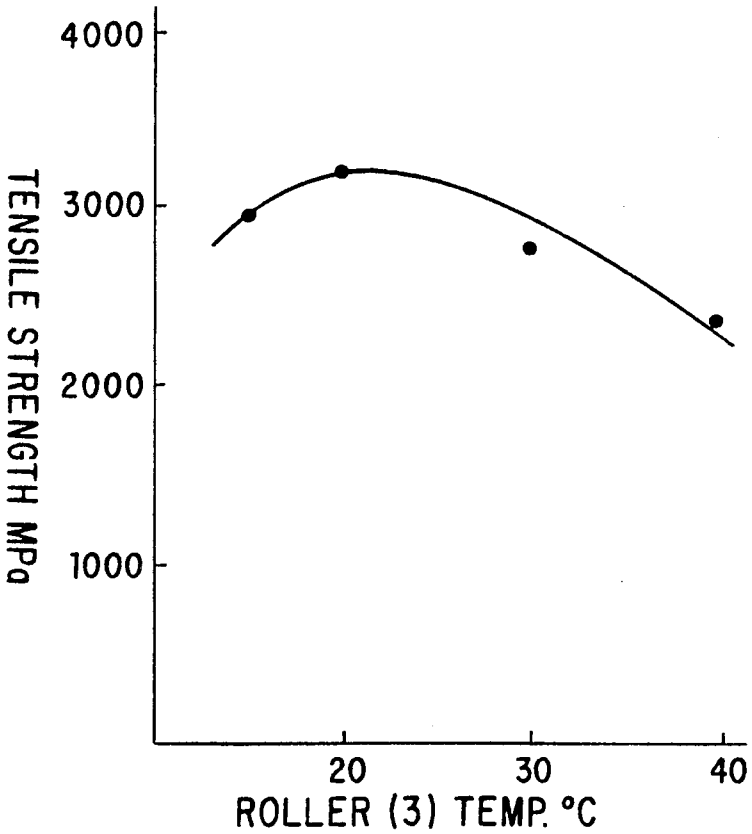
FIG. 7 is a graph plotting the tensile strength as a function of the temperature of a drafting roller for various fibers.

Samples of fiber are made in accordance with the present invention using different drafting roller temperatures. Using the apparatus described hereinabove, spinning conditions are the same as in Example 12, with the temperature of the first coagulating bath at 5° C., except that the stretch ratio is the 0.5× the maximum stretch ratio, which was determined as in Examples 1-6. The temperature of the drafting roller is varied and the tensile strength and tensile modulus determined as in Examples 1-6. The various temperatures and results are recorded in FIGS. 7 and 8. As seen in the Figs., tensile modulus increases markedly as the temperature increases, then decreases sharply as the temperature is increased further. The temperature of the drafting roller has a similar effect on tensile strength, but both the increase and decrease are not as marked.

I claim:

1. A method of making a fiber comprising the sequential steps of:

a) extruding as a stream a solution of a polymer having a polymer concentration of 4-24 weight % into a non-coagulating fluid;

b) stretching the stream while in the non-coagulating fluid at a spinning draft of 25-2000;

c) passing the stream through a coagulating fluid so as to increase the polymer concentration by at least 2 weight % to a concentration of 20-65 weight %;

d) stretching the stream at a stretch ratio of 1.5-10; and simultaneously or subsequently e) passing the stream through a coagulating fluid so as to increase the polymer concentration in the stream sufficiently to form the fiber.

2. The method of making a fiber comprising the sequential steps of:

a) extruding as a stream a solution of a polymer having a polymer concentration of 4-24 weight % into a first non-coagulating fluid;

b) stretching the stream while in the first non-coagulating fluid at a spinning draft of 25-20000;

c) passing the stream through a first coagulating bath so as to increase the polymer concentration by at least 2 weight % to a concentration of 20-65 weight %;

d) heating the stream to a temperature between the swelling point of the polymer in the solvent and the melting point of the polymer;

e) stretching the stream at a stretch ratio of 1.5-10 in a second non-coagulating fluid; and f) passing the stream through a second coagulating bath to form a fiber of the polymer.

3. The method of claim 2 wherein the polymer is a liquid crystalline main chain polymer.

4. The method of claim 3 wherein the stream is passed through the first coagulating bath so as to increase the polymer concentration at least 10 weight % to 30-40 weight %.

5. The method of claim 3 comprising stretching the stream while in the first non-coagulating fluid at a spinning draft of 100-2000.

6. The method of claim 3 wherein the temperature of the non-coagulating fluid is 60°-95° C.

7. The method of claim 3 wherein the temperature of the first coagulating bath is 5°-25° C.

8. The method of claim 3 wherein the temperature of the second coagulating bath is 5°-25° C.

9. The method of claim 3 wherein the liquid crystalline main chain polymer is a polyamide.

10. The method of claim 3 wherein the temperature of the stream is raised at least 5° C. to a temperature between 15°-80° C. after leaving the first coagulating bath.

11. The method of claim 3 further comprising the step of heat treating the fiber at a temperature of 450°-600° C.

* * * * *